United States Patent [19]

Rhodes

[11] 4,162,956

[45] Jul. 31, 1979

[54] COAL DEASHING PROCESS HAVING IMPROVED SOLVENT RECOVERY TECHNIQUES

[75] Inventor: Donald E. Rhodes, Oklahoma City, Okla.

[73] Assignee: Kerr-McGee Corporation, Oklahoma City, Okla.

[21] Appl. No.: 887,866

[22] Filed: Mar. 20, 1978

[51] Int. Cl.[2] ..... C10G 1/00

[52] U.S. Cl. ..... 208/8 LE

[58] Field of Search ..... 208/8 LE

[56] References Cited

U.S. PATENT DOCUMENTS

| | | | |
|---|---|---|---|
| 3,607,716 | 9/1971 | Roach | 208/10 X |
| 3,607,717 | 9/1971 | Roach | 208/8 LE |
| 3,607,718 | 9/1971 | Leaders et al. | 208/8 LE X |
| 3,642,608 | 2/1972 | Roach et al. | 208/8 LE |
| 3,852,183 | 12/1974 | Snell | 208/8 LE X |
| 3,856,675 | 12/1974 | Sze et al. | 208/8 LE X |
| 4,008,054 | 2/1977 | Clancey et al. | 208/8 LE X |
| 4,008,145 | 2/1977 | Leas | 208/8 LE |
| 4,070,268 | 1/1978 | Davis et al. | 208/8 LE |

*Primary Examiner*—Delbert E. Gantz

*Assistant Examiner*—William G. Wright

*Attorney, Agent, or Firm*—William G. Addison

[57] ABSTRACT

An improved coal deashing process wherein coal is mixed with a coal liquefaction process solvent, solubilized and flashed to provide a prepared mixture and the prepared mixture is mixed with a deashing solvent to produce a feed mixture. Thereafter, the feed mixture is separated in a first separation zone into a first heavy fraction comprising insoluble coal products and a first light fraction comprising soluble coal products and solvents. The first light fraction is recovered and a second portion of the deashing solvent is mixed with the first light fraction prior to introduction into a second separation zone wherein an improved separation occurs to produce a second light fraction comprising the solvents and a second heavy fraction comprising the soluble coal products which is recovered. The second light fraction is withdrawn and separated in a third separation zone into a third heavy fraction comprising the liquefaction process solvent for recycle to aid in solubilization of the coal and a third light fraction comprising the deashing solvent for recycle to aid in the production of the feed mixture.

13 Claims, 3 Drawing Figures

COAL DEASHING PROCESS HAVING IMPROVED SOLVENT RECOVERY TECHNIQUES

BACKGROUND OF THE INVENTION

1. Field of the invention

The present invention relates generally to coal deashing processes and, more particularly, but not by way of limitation to improved solvent recovery systems in coal deashing processes.

2. Description of the Prior Art

Various coal deashing processes have been developed in the past wherein coal has been treated with one or more solvents and processed to separate the resulting insoluble coal products from the soluble coal products, some systems including provisions for recovering and recycling the solvents.

U.S. Pat. Nos. 3,607,716 and 3,607,717, issued to Roach and assigned to the same assignee as the present invention, disclose processes wherein coal is contacted with a solvent and the resulting mixture then is separated into a heavy phase containing the insoluble coal products and a light phase containing the soluble coal products. In such processes, the light phase is withdrawn and passed to downstream fractionating vessels wherein the soluble coal products are separated into multiple fractions. Other processes for separating the soluble coal products from the insoluble coal products utilizing one or more solvents are disclosed in U.S. Pat. Nos. 3,607,718 and 3,642,608, both issued to Roach et al., and assigned to the same assignee as the present invention.

SUMMARY OF THE INVENTION

The discovery now has been made that practice of the process to be hereinafter described results in an improved recovery of coal liquefaction process solvent for reutilization in coal solubilization processes.

In general, coal to be processed in accordance with the present invention is contacted and mixed with a coal liquefaction process solvent in a first mixing zone and processed to provide a prepared mixture which is passed into a second mixing zone. In the second mixing zone, the prepared mixture is mixed with a deashing solvent to provide a feed mixture which is passed to a first separation zone wherein the feed mixture is separated into a first light fraction and a first heavy fraction. The first light fraction comprising soluble coal products, deashing solvent and process solvent is passed to a third mixing zone wherein it is mixed with at least a portion of a third light fraction from a third separation zone. The mixture then passes from the third mixing zone to enter a second separation zone wherein the mixture is separated into a second light fraction and a second heavy fraction. The second light fraction comprising process solvent and deashing solvent then passes to a third separation zone wherein the second light fraction separates into a third light fraction comprising deashing solvent and a third heavy fraction comprising process solvent. The third light fraction is withdrawn and at least a portion is returned to the third mixing zone, the remainder is returned to the second mixing zone to aid in producing the feed mixture.

The third heavy fraction is withdrawn and at least a portion is returned to the first mixing zone to aid in the solubilization of the coal.

The recycle of at least a portion of the deashing solvent to the third mixing zone results in an improved separation and recovery of the process solvent for reutilization in the first mixing zone. Such recovery reduces the cost of processing the coal and provides a process which is more economical in operation.

In another embodiment of the invention, the first light fraction is passed to a third mixing zone wherein the first light fraction is mixed with at least a portion of a fourth light fraction from a fourth separation zone. The mixture then is passed to a second separation zone wherein the mixture separates into a second light fraction comprising deashing solvent and process solvent, and a second heavy fraction comprising soluble coal products, deashing solvent and process solvent. The second light fraction then is passed to a third separation zone wherein the second light fraction separates into a third light fraction and a third heavy fraction. The third light fraction is withdrawn and at least a portion thereof is introduced with the second heavy fraction withdrawn from the second separation zone into a fourth separation zone. In the fourth separation zone, the second heavy fraction and the portion of the third light fraction separate into a fourth heavy fraction comprising the soluble coal products and some deashing solvent and a fourth light fraction comprising deasing solvent and process solvent, a portion of which is returned to the third mixing zone.

The deashing solvent is recovered from the first and second heavy fractions and returned to mix with deashing solvent recovered as the third light fraction. A portion of the deashing solvent is introduced into the fourth separation zone and the remainder is returned to the second mixing zone to aid in providing the feed mixture.

The recycle of at least a portion of the fourth light fraction to the third mixing zone increases the solvent to feed ratio and results in an improved separation and recovery of the process solvent for re-utilization in the first mixing zone.

DESCRIPTION OF THE PREFERRED EMBODIMENT

Figure 1:
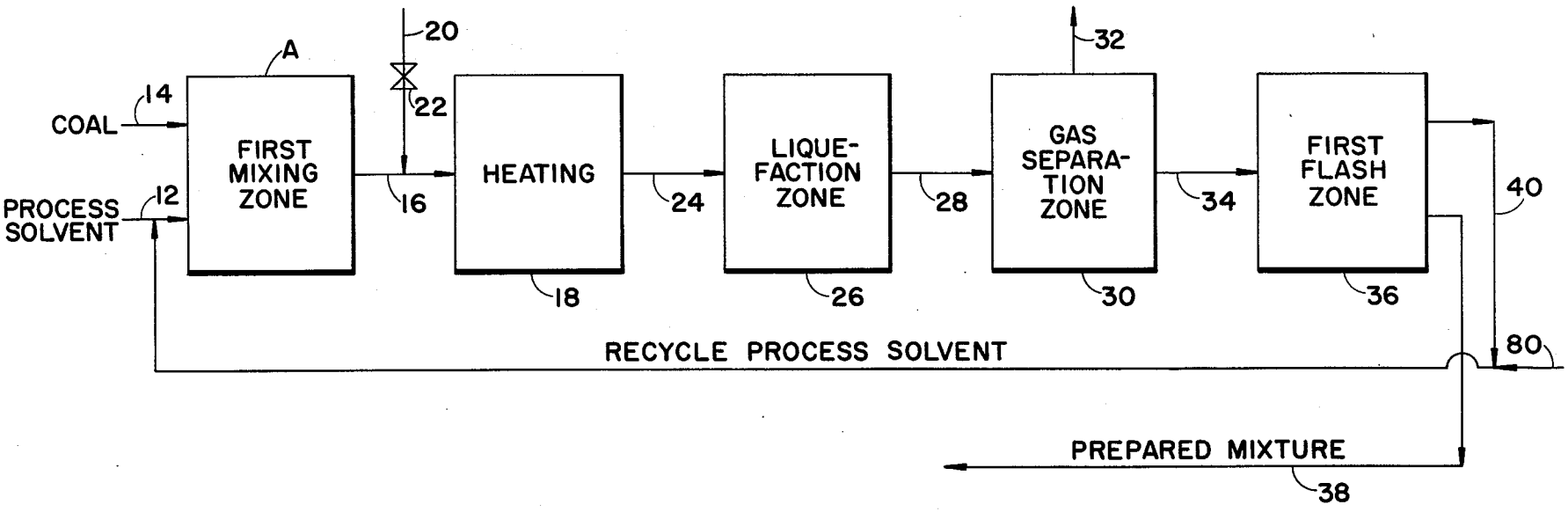
FIG. 1, diagrammatically and schematically illustrates a coal liquefaction process.

Turning now to the coal liquefaction process illustrated in FIG. 1, liquefaction process solvent is introduced from a source (not shown) through a conduit 12 into a first mixing zone A.

Pulverized coal maintained in a coal storage vessel or the like (not shown) is passed into the first mixing zone A through a conduit 14 at a rate controlled by a solids feeder or the like (not shown) interposed in the conduit 14.

In the first mixing zone A, the coal and the process solvent are agitated or mixed with a stirring mechanism (not shown) to form a slurry. That slurry is withdrawn from the first mixing zone A through a conduit 16 and pumped (pump not shown) to a heater 18 where the slurry is heated. In one preferred embodiment, gaseous hydrogen is passed from a source (not shown) through a conduit 20 connected to the conduit 16, the gaseous hydrogen being mixed with the slurry flowing through the conduit 16 and the resulting mixture being heated in the heater 18. A valve 22 is interposed in the conduit 20 for controlling the flow of the gaseous hydrogen to be mixed with the slurry flowing through the conduit 16.

The slurry, which may include the gaseous hydrogen, is discharged from the heater 18 at a temperature of about 800 degrees F. and passed through a conduit 24 into a liquefaction zone 26 to effect solubilization of a substantial portion of the coal. In one embodiment, the pressure level in liquefaction zone 26 is greater than about 1200 psig and preferably in a range of from about 1200 psig to about 2000 psig.

In the liquefaction zone 26, the process solvent is contacted with the coal at an elevated liquefaction temperature and pressure for a period of time sufficient to solubilize at least a portion of the coal and produce a mixture of coal liquefaction products (comprising soluble coal products and insoluble coal products and process solvent).

The mixture of coal liquifaction products is withdrawn from the liquefaction zone 26 and passed through a conduit 28 into a gas separation zone 30, which includes a degassing vessel or the like, wherein the mixture is degassed by permitting the excess hydrogen, other gases and vapors to be discharged through a conduit 32. In some operational embodiments, the hydrogen-containing gases are discharged through the conduit 32 and passed to a hydrogen recycle system (not shown) for re-use in the process. In one embodiment, the temperature level of the mixture in the gas separation zone 30 is about 800 degrees F. and the pressure level is in the range of from about 1200 psig to about 1500 psig.

The degassed mixture is discharged from the gas separation zone 30 and passed through a conduit 34 into a first flash zone 36, which includes a flash vessel, an atmospheric or vacuum distillation vessel or the like (not shown). In the first flash zone 36, the mixture discharged from the gas separation zone 30, which includes soluble coal products and insoluble coal products is separated to produce one stream comprising the prepared mixture which is passed from the first flash zone 36 through a conduit 38 and one other overhead stream comprising process solvent which is passed through a line 40 back to line 12 for re-use in the system.

In the operational embodiment referred to before, the pressure level in the first flash zone 36 is less than about 20 psig. In one preferred operation of the process, the temperature in the first flash zone 36 is maintained below about 650° F.

The coal liquefaction process hereinbefore described has been cited merely to illustrate one means of coal conversion and it therefore is not intended to limit the scope of the present invention to that particular means. The process of the present invention would be equally applicable to any other technique which employs solvents to yield coal liquefaction products.

Figure 2:
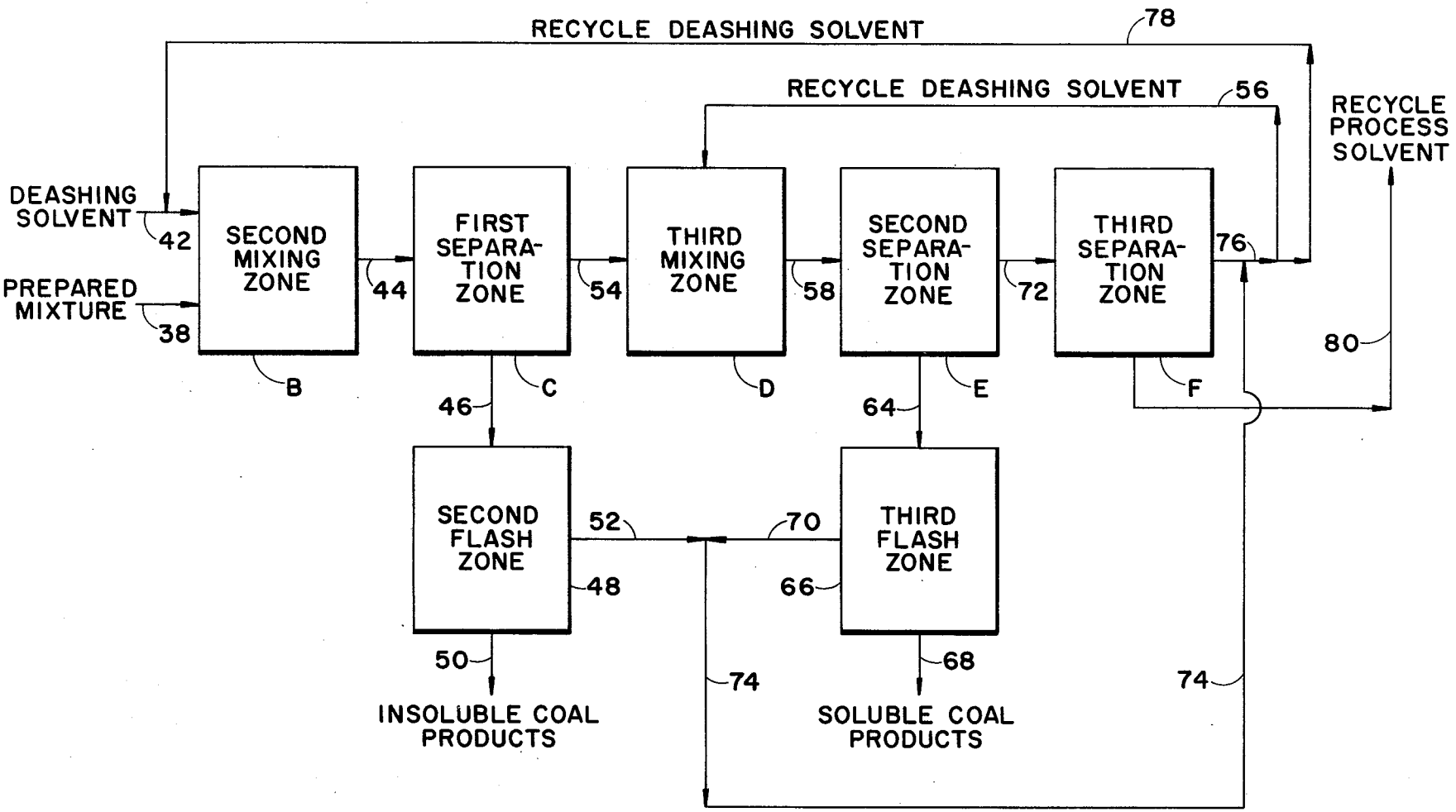
FIG. 2, diagrammatically and schematically illustrates a coal deashing system arranged in accordance with the present invention.

Turning now to FIG. 2, the mixture consisting essentially of the soluble coal products, insoluble coal products and some process solvent (referred to herein as the "prepared mixture"), is pumped (pump not shown) from the first flash zone 36 through the conduit 38 into the second mixing zone B. The deashing solvent is introduced into a second mixing zone B through a conduit 42.

The term "insoluble coal products" as used herein refers to the undissolved coal, mineral matter, other solid inorganic particulate matter and other such matter which is insoluble in the deashing solvent under the conditions of the present invention. The term "soluble coal products" as used herein refers to the constituents in the coal which are soluble in the deashing solvent under the conditions of the present invention.

In the second mixing zone B, the mixture discharged from the first flash zone 36 is contacted by and mixed with the deashing solvent and the resulting mixture is discharged from the second mixing zone B into and through a conduit 44, such resulting mixture comprising and being referred to herein as the "feed mixture."

The embodiment shown in the figures contemplates the utilization of two, different solvents, one of the solvents being introduced into the first mixing zone A and referred to herein as the "liquefaction process solvent or process solvent", and one other solvent being introduced into the second mixing zone B and referred to herein as the "deashing solvent." In the embodiment of the present invention shown in the figures, the process solvent preferably is an organic solvent suitable for liquefying coal in the manner herein described. Various solvents suitable for use as the process solvent are described in detail in U.S. Pat. Nos. 3,607,716, 3,607,717, 3,607,718 and 3,642,608, the disclosures of which are included herein by reference. The deashing solvent is of the type sometimes described as a "light organic solvent" in the just mentioned patents and include, for example, pyridine, cresols, benzene and toluene. More specifically, the deashing solvent consists essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs.

The feed mixture passes via conduit 44 to enter a first separation zone C. The first separation zone C is maintained at a temperature level in a range of from about 400 degrees F. to about 620 degrees F. and a pressure level in a range of from about 500 psig to about 1500 psig to effect a separation of the feed mixture. The feed mixture separates into a first light fraction comprising the soluble coal products, deashing solvent and some process solvent and a first heavy fraction comprising the insoluble coal products, and some deashing solvent.

The first heavy fraction is withdrawn from first separation zone C via a conduit 46 and passed to a second flash zone 48. In second flash zone 48, the first heavy fraction is flashed to produce one stream comprising the insoluble coal products which is passed from the second flash zone 48 through a conduit 50 and one other overhead stream comprising the deashing solvent which is passed through a line 52 for eventual recycle to the process.

The first light fraction passes via a conduit 54 to enter a third mixing zone D. In third mixing zone D the first light fraction is contacted by and mixed with at least a portion of a recycled third light fraction comprising the deashing solvent from a third separation zone F, to be more fully described hereinafter, entering via a conduit 56. The resulting mixture then passes via a conduit 58 to enter a second separation zone E.

The second separation zone E is maintained at a temperature level in a range of from about 500 degrees F. to about 900 degrees F. and a pressure level in a range of from about 300 psig to about 1500 psig to effect a separation of the mixture. In second separation zone E, the mixture separates into a second light fraction comprising the liquefaction process and deashing solvents and a second heavy fraction comprising the soluble coal products and some process solvent and some deashing solvent.

The second heavy fraction is withdrawn from the second separation zone E via a conduit 64 to enter a third flash zone 66. In third flash zone 66, the second heavy fraction is flashed to produce one stream comprising the soluble coal products which is passed from the third flash zone 66 via a conduit 68 and recovered and one other overhead stream comprising the deashing solvent. The deashing solvent is passed from the third flash zone 66 through a conduit 70 to connect to conduit 52 and flow via a conduit 74 to enter conduit 76 to mix with a third light fraction contained therein.

The second light fraction is withdrawn from the second separation zone E via a conduit 72 to enter a third separation zone F.

The third separation zone F is maintained at a pressure level of from atmospheric pressure to about 1500 psig and a temperature level sufficiently high to effect a separation of the second light fraction into a third light fraction comprising the deashing solvent and a third heavy fraction comprising the liquefaction process solvent.

The third light fraction is withdrawn via a conduit 76. At least a portion of the third light fraction in conduit 76 is returned by conduit 56 to the third mixing zone D to provide a higher solvent to feed ratio than provided in the first separation zone C to thereby increase the fractionation capabilities in the second and third separation zones.

The temperature control in the second separation zone E and the third separation zone F may be effected by heaters (not shown) interposed in conduits 58 and 72 respectively.

The improved fractionation capability is believed to occur because of the lower solvent to feed ratio in the first separation zone C which enables an improved separation of insoluble coal products from the soluble coal products to be effected. The soluble coal products then are separated from the solvents by increasing the solvent to feed ratio in the second separation zone to enable an improved fractionation or separation of the soluble coal products from the liquefaction process and deashing solvents, and thereby provide an improved recovery of the solvents.

The remainder of the third light fraction passes by a conduit 78 for recycle via conduit 42 to the second mixing zone B to aid in providing the feed mixture.

The third heavy fraction comprising the first dissolving solvent passes via a conduit 80 for recycle along with the process solvent in conduit 40 to the first mixing zone A to aid in solubilizing the coal.

Figure 3:
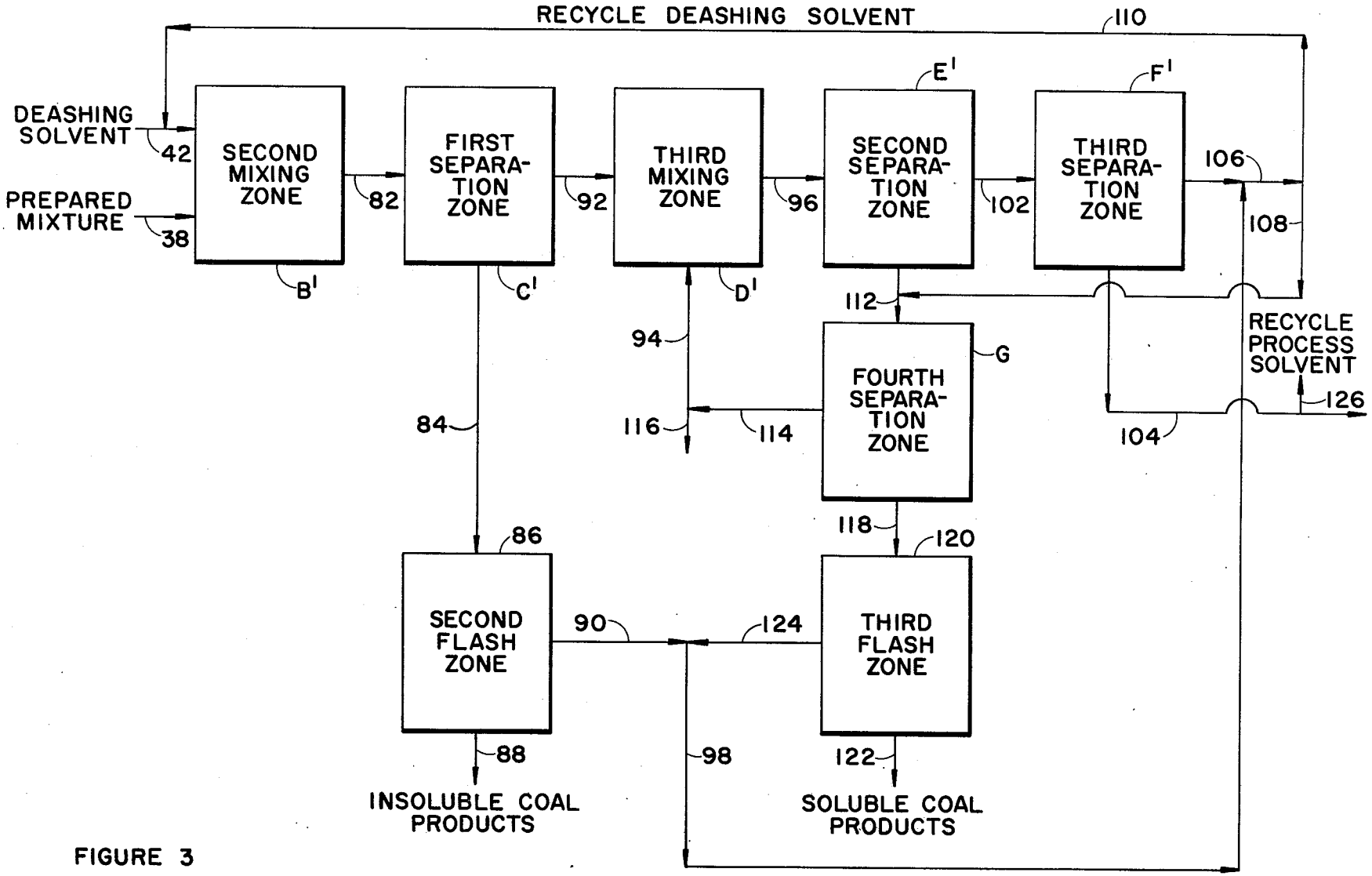
FIG. 3, diagrammatically and schematically illustrates another coal deashing system.

Turning now to FIG. 3, another embodiment of the present invention is provided.

In this embodiment, the prepared mixture flowing in conduit 38 enters a second mixing zone B′ wherein it is contacted by and mixed with a deashing solvent entering the second mixing zone B′ via conduit 42 to provide the feed mixture. The feed mixture then passes via a conduit 82 to a first separation zone C′.

The first separation zone C′ is maintained at a temperature level in a range of from about 400 degrees F. to about 620 degrees F. and a pressure level in a range of from about 500 psig to about 1500 psig to effect a separation of the feed mixture into a first light fraction and a first heavy fraction comprising the insoluble coal products some of the deashing solvent and some of the process solvent.

The first heavy fraction is withdrawn from the first separation zone C′ via a conduit 84 and passed to a second flash zone 86. In second flash zone 86, the first heavy fraction is flashed to produce one stream comprising the insoluble coal products which is withdrawn via a conduit 88 and one other overhead stream comprising the deashing solvent which is passed via a conduit 90 and a conduit 98 for recycle to mix with a third light fraction in a conduit 106.

The first light fraction comprising the soluble coal products, deashing solvent and some process solvent is withdrawn via a conduit 92 and passed to enter a third mixing zone D′.

In third mixing zone D′, the first light fraction is contacted by and mixed with at least a portion of a recycled fourth light fraction from a fourth separation zone G to be more fully described hereinafter, entering via a conduit 94. The resulting mixture then passes via a conduit 96 to a second separation zone E′.

The second separation zone E′ is maintained at a temperature level in a range of from about 500 degrees F. to about 900 degrees F. and a pressure level in the range of from about 300 psig to about 1500 psig to effect a separation of the first light fraction and deashing solvent mixture.

In second separation zone E′, the mixture separates into a second light fraction comprising the deashing solvent and some process solvent and a second heavy fraction comprising some process solvent, some deashing solvent and the soluble coal products.

The second light fraction is withdrawn via a conduit 102 from the second separation zone E′ and passed to a third separation zone F′.

The third separation zone F′ is maintained at a pressure level in the range of from atmospheric pressure to about 1500 psig and at a temperature level sufficiently high to effect a separation of the second light fraction into a third light fraction and a third heavy fraction comprising the process solvent.

The third heavy fraction is withdrawn from the third separation zone F′ via a conduit 104 and at least a portion of the third heavy fraction in conduit 104 is withdrawn via a conduit 126 for recycle to the first mixing zone (see FIG. 1) to aid in solubilizing the coal and thereby reduce the amount of makeup liquefaction process solvent required.

The third light fraction comprising the deashing solvent is withdrawn via a conduit 106. At least a portion of the third light fraction flowing in conduit 106 passes by a conduit 108 to eventually enter the fourth separation zone G. The remainder of the third light fraction, flowing in conduit 106, passes by a conduit 110 to return to the second mixing zone B′ to aid in providing the feed mixture.

The second heavy fraction from the second separation zone E′ is withdrawn via a conduit 112 to which conduit 108 connects to enter the fourth separation zone G.

The fourth separation zone G is maintained at a pressure level in the range of from about 300 psig to about 1500 psig and a temperature level sufficiently high to effect a separation of the mixture contained therein. More specifically, the temperature level is maintained in the range of from about 500 degrees F. to about 950 degrees F.

In the fourth separation zone G, the mixture of second heavy fraction and third light fraction separates into a fourth light fraction comprising the deashing solvent and some process solvent and a fourth heavy fraction comprising the soluble coal products.

The fourth light fraction, contained in the fourth separation zone G, is withdrawn via a conduit 114. At least a portion of this fourth light fraction is separated and flows by the conduit 94 to enter the third mixing zone D' to increase the solvent to feed ratio and thereby improve the subsequent soluble coal products separation from the solvents to increase the amount of recoverable liquefaction process and deashing solvents for re-utilization in the process of this invention. The remainder, if any, of the fourth light fraction not passed to the third mixing zone D' passes by a conduit 116 for recycle to the second mixing zone B' (not shown).

The fourth heavy fraction comprising the soluble coal products and some deashing solvent is withdrawn via a conduit 118 and passed to a third flash zone 120.

In the third flash zone 120 the fourth heavy fraction is flashed to provide one stream comprising the soluble coal products which is passed from the third flash zone 120 via a conduit 122 and recovered and one other overhead stream comprising the deashing solvent. The deashing solvent is passed from the third flash zone 120 via a conduit 124 for recycle to conduit 106.

Thus, the practice of the invention hereinbefore disclosed provides a process wherein the loss of liquefaction process solvent is reduced and a more economical process results.

While the invention has been described in what are presently considered to be the preferred embodiments thereof, it is to be understood that changes or modifications can be made in the process described without departing from the spirit or scope of the invention as defined by the appended claims.

What is claimed is:

1. A process comprising:

mixing in a first mixing zone a process solvent with coal;

solubilizing the coal at elevated temperature and pressure and flashing the resultant mixture to produce a prepared mixture comprising soluble coal products, insoluble coal products and some of the process solvent;

mixing the prepared mixture with a deashing solvent in a second mixing zone to provide a feed mixture, said deashing solvent consisting essentially of at least one substance having a critical temperature below 800 degrees F. selected from the group consisting of aromatic hydrocarbons having a single benezene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

introducing the feed mixture into a first separation zone and separating said mixture into a first heavy fraction comprising insoluble coal products and some deashing solvent and first light fraction comprising soluble coal products, deashing solvent and some process solvent;

withdrawing the first heavy fraction from the first separation zone;

introducing the first light fraction into a third mixing zone;

introducing at least a portion of a third light fraction from a third separation zone into the third mixing zone to mix with the first light fraction contained therein;

withdrawing the mixture from the third mixing zone;

introducing the mixture into a second separation zone;

separating the mixture in the second separation zone into a second heavy fraction comprising soluble coal products and some deashing solvent and a second light fraction comprising deashing solvent and some process solvent;

withdrawing the second heavy fraction from the second separation zone;

withdrawing the second light fraction from the second separation zone;

introducing the second light fraction into a third separation zone;

separating the second light fraction into a third heavy fraction comprising process solvent and a third light fraction comprising deashing solvent;

withdrawing the third light fraction from the third separation zone;

returning at least a portion of the third light fraction comprising deashing solvent to the third mixing zone for introduction therein;

returning the remaining third light fraction to the second mixing zone to aid in providing the feed mixture;

withdrawing the third heavy fraction from the third separation zone; and returning at least a portion of the third heavy fraction to the first mixing zone to aid in solubilizing said coal.

2. The process of claim 1 defined further to include the steps of:

flashing the withdrawn first heavy fraction in a second flash zone to produce one stream comprising insoluble coal products and one other stream comprising deashing solvent and;

flashing the second heavy fraction in a third flash zone to produce one stream comprising soluble coal products and one other stream comprising deashing solvent.

3. The process of claim 1 defined further to include the step of:

maintaining the first separation zone at a temperature level in a range of from about 400 degrees F. to about 620 degrees F. and a pressure level in a range of from about 500 psig to about 1500 psig to effect the separation of the feed mixture.

4. The process of claim 1 defined further to include the step of:

maintaining the second separation zone at a temperature level in the range of from about 500 degrees F. to about 900 degrees F. and a pressure level in a range of from about 300 psig to about 1500 psig to effect the separation within the second separation zone.

5. The process of claim 1 defined further to include the step of:

maintaining the third separation zone at an elevated temperature and a pressure level in a range of from atmospheric pressure to about 1500 psig to effect the separation in the third separation zone.

6. A process comprising:

mixing in a first mixing zone a process solvent with coal;

solubilizing the coal at elevated temperature and pressure and flashing the resultant mixture to produce a prepared mixture comprising the process solvent, soluble coal products and insoluble coal products;

mixing the prepared mixture with a deashing solvent in a second mixing zone to provide a feed mixture, said deashing solvent consisting essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

introducing the feed mixture into a first separation zone;

separating the feed mixture in the first separation zone into a first heavy fraction comprising insoluble coal products and some deashing solvent and a first light fraction comprising soluble coal products, deashing solvent and some process solvent;

withdrawing the first heavy fraction from the first separation zone;

withdrawing the first light fraction from the first separation zone;

introducing the first light fraction into a third mixing zone;

mixing the first light fraction with a least a portion of a fourth light fraction obtained from a fourth separation zone to form a mixture;

withdrawing the mixture from the third mixing zone;

introducing the mixture into a second separation zone;

separating the mixture in the second separation zone into a second heavy fraction comprising soluble coal products, some deashing solvent and some process solvent and a second light fraction comprising deashing solvent and some process solvent;

withdrawing the second heavy fraction from the second separation zone;

withdrawing the second light fraction from the second separation zone;

introducing the second light fraction into a third separation zone;

separating the second light fraction in the third separation zone into a third heavy fraction comprising process solvent and a third light fraction comprising deashing solvent;

withdrawing the third heavy fraction from the third separation zone;

withdrawing the third light fraction from the third separation zone;

passing at least a portion of the third light fraction to the second mixing zone to aid in providing the feed mixture;

introducing the remaining third light fraction into a fourth separation zone;

introducing the second heavy fraction withdrawn from the second separation zone into the fourth separation zone;

separating the second heavy fraction and third light fraction in the fourth separation zone into a fourth heavy fraction comprising soluble coal products and some deashing solvent and a fourth light fraction comprising deashing solvent and some process solvent;

withdrawing the fourth heavy fraction from the fourth separation zone;

withdrawing the fourth light fraction from the fourth separation zone; and passing at least a portion of the fourth light fraction withdrawn from the fourth separation zone into the third mixing zone to mix with the first light fraction contained therein.

7. The process of claim 6 defined further to include the step of:

maintaining the temperature level in the first separation zone in the range of from about 400 degrees F. to about 620 degrees F. and a pressure level in a range of from about 500 psig to about 1500 psig to effect the separation of the feed mixture.

8. The process of claim 6 defined further to include the step of:

flashing the first heavy fraction in a second flash zone to produce one stream comprising insoluble coal products and one other stream comprising deashing solvent.

9. The process of claim 6 defined further to include the step of:

passing the third heavy fraction, comprising the process solvent, withdrawn from the third separation zone to the first mixing zone to aid in solubilizing the coal.

10. The process of claim 6 defined further to include the steps of:

flashing the fourth heavy fraction withdrawn from the fourth separation zone in a third flash zone to produce one stream comprising soluble coal products and one other stream comprising deashing solvent.

11. The process of claim 6 defined further to include the step of:

maintaining the second separation zone at a temperature level in a range of from about 500 degrees F. to about 900 degrees F. and a pressure level in a range of from about 300 psig to about 1500 psig to effect the separation in the second separation zone.

12. The process of claim 11 defined further to include the step of:

maintaining the third separation zone at an elevated temperature and a pressure level in a range of from atmospheric pressure to about 1500 psig to effect the separation the third separation zone.

13. The process of claim 11 defined further to include the step of:

maintaining the fourth separation zone at a temperature level higher than the temperature level in the second separation zone and a pressure level in a range of from about 300 psig to about 1500 psig to effect the separation in the fourth separation zone.

* * * * *